US007765895B2

(12) United States Patent
Junkers

(10) Patent No.: US 7,765,895 B2
(45) Date of Patent: Aug. 3, 2010

(54) FLUID-OPERATED TORQUE WRENCH FOR AND METHOD OF TIGHTENING OR LOOSENING FASTENERS

(76) Inventor: John K. Junkers, 14 Algonquin Trail, Saddle River, NJ (US) 07458

( * ) Notice: Subject to any disclaimer, the term of this patent is extended or adjusted under 35 U.S.C. 154(b) by 0 days.

(21) Appl. No.: 11/926,285

(22) Filed: Oct. 29, 2007

(65) Prior Publication Data

US 2009/0107305 A1 Apr. 30, 2009

(51) Int. Cl.
*B25B 23/145* (2006.01)
*B25B 13/46* (2006.01)

(52) U.S. Cl. ..... 81/57.39; 81/473

(58) Field of Classification Search ..... 81/57.13, 81/57.29, 57.39, 57.4, 57.16, 57.36; D8/61
See application file for complete search history.

(56) References Cited

U.S. PATENT DOCUMENTS

| | | | | | |
|---|---|---|---|---|---|
| 2,112,693 | A | * | 3/1938 | Douglass | 173/93 |
| 2,972,918 | A | * | 2/1961 | Huff et al. | 81/57.32 |
| 3,361,218 | A | | 1/1968 | States | |
| 3,706,244 | A | * | 12/1972 | Wilmeth | 81/57.32 |
| 4,091,890 | A | * | 5/1978 | Wilmeth et al. | 81/57.39 |
| 4,106,371 | A | * | 8/1978 | Akiyoshi et al. | 81/57.14 |
| 4,132,136 | A | * | 1/1979 | Wilmeth | 81/57.39 |
| 4,179,955 | A | * | 12/1979 | Akiyoshi et al. | 81/57.11 |
| 4,429,597 | A | | 2/1984 | Grabovac et al. | |
| 4,432,256 | A | | 2/1984 | Aparicio, Jr. et al. | |
| 4,480,510 | A | | 11/1984 | Aparicio et al. | |
| 4,538,484 | A | | 9/1985 | Hardy et al. | |
| 4,549,438 | A | | 10/1985 | Grabovac et al. | |
| 4,607,546 | A | | 8/1986 | Wagner | |
| 4,619,160 | A | | 10/1986 | Meyer | |
| 4,671,142 | A | | 6/1987 | Junkers | |
| 4,706,526 | A | | 11/1987 | Junkers | |
| 4,706,527 | A | * | 11/1987 | Junkers | 81/57.39 |
| 4,794,825 | A | * | 1/1989 | Schmoyer | 81/57.39 |
| 4,825,730 | A | * | 5/1989 | Junkers | 81/57.39 |
| 4,928,558 | A | | 5/1990 | Makhlouf | |
| 5,016,502 | A | | 5/1991 | Junkers | |

(Continued)

FOREIGN PATENT DOCUMENTS

| | | |
|---|---|---|
| DE | 2 230 955 | 1/1974 |

(Continued)

*Primary Examiner*—David B Thomas
(74) *Attorney, Agent, or Firm*—Michael J. Striker

(57) ABSTRACT

A fluid-operated torque wrench for tightening or loosening a fastener has a housing having two housing portions including a cylinder portion and a driving portion, cylinder-piston means arranged in the cylinder portion and movable along a first axis, a lever-type ratchet mechanism arranged in the driving portion and connected to the cylinder-piston means to be driven by the later, the lever-type ratchet mechanism having a ratchet turnable about a second axis which is perpendicular to the first axis, at least three connecting elements including first and second connecting elements receiving a given turning force acting in one direction during operation of the wrench, and a third connecting element receiving a turning force in an opposite direction during operation of the wrench and being equal to the given turning force acting in the one direction, so that one of the turning forces turns a fastener to be tightened or loosened while another of the turning forces is transferred to a stationary object.

6 Claims, 2 Drawing Sheets

U.S. PATENT DOCUMENTS

| | | | | |
|---|---|---|---|---|
| 5,027,932 | A | 7/1991 | Graffin | |
| 5,142,951 | A * | 9/1992 | Walton | 81/57.39 |
| 5,152,200 | A | 10/1992 | Kaplan | |
| 5,301,574 | A | 4/1994 | Knopp et al. | |
| 5,495,782 | A * | 3/1996 | Ruessmann et al. | 81/57.39 |
| 5,791,619 | A | 8/1998 | Myers | |
| 6,152,243 | A * | 11/2000 | Junkers | 173/176 |
| 6,260,443 | B1 | 7/2001 | Spirer | |
| 6,715,381 | B2 | 4/2004 | Junkers | |
| D500,650 | S * | 1/2005 | Prais | D8/61 |
| 7,013,760 | B1 | 3/2006 | Kennison | |
| 7,284,463 | B2 | 10/2007 | DeCelles et al. | |
| 2002/0073808 | A1 * | 6/2002 | Jamra et al. | 81/57.39 |
| 2003/0131459 | A1 | 7/2003 | Morita | |
| 2007/0028723 | A1 | 2/2007 | De Celles et al. | |

FOREIGN PATENT DOCUMENTS

| | | |
|---|---|---|
| DE | 299 01 000 | 4/1999 |
| DE | 10 2006 013 147 | 9/2007 |
| EP | 1 321 239 | 6/2003 |
| GB | 2 060 453 | 5/1981 |
| PL | 156043 | 1/1992 |
| PL | 179865 | 11/2000 |
| RU | 2 104 146 | 2/1998 |
| SU | 1049243 | 10/1983 |
| SU | 1618615 | 1/1991 |

* cited by examiner

FLUID-OPERATED TORQUE WRENCH FOR AND METHOD OF TIGHTENING OR LOOSENING FASTENERS

BACKGROUND OF THE INVENTION

The present invention relates to a fluid-operated torque wrench for and a method of tightening and loosening fasteners.

Power-driven torque tools require the use of reaction members. Reaction members usually abut against a stationary object, such as for example an adjacent nut, to stop the tool housing from turning backwards, while a fastener, such as for example a nut, turns forwards. The abutment force for the tool with a torque 10,000 ft. lb can be as high as 30,000 lb, which is applied as a side load to the adjacent nut in one direction and to the nut to be turned in the opposite direction. This enormous abutment force tries to bend the bolt and to increase the turning friction of the nut. On regular applications this is not a problem because the bolt is designed to take the side loads, and the torque recommendations by manufacturers of equipment usually take the side load into consideration.

The problem occurs during tightening up of critical applications when a scatter of a bolt load applied to all fasteners on a flange or a casing can not vary too much, or when loosening of corroded fasteners. The corrosion of a corroded fastener usually occurs between the engaging threads of the nut and the bolt. On hot applications, grease applied for assembly usually dries up and binds the threads together. When a high torque with a high side load is applied to such a nut, then merely a half of the threads between the bolt and the nut are engaged on one side and the threads on the engaged side start gripping. This causes the bolt thread to gall and requires more torque and thus more side load to take the nut off, which can totally ruin the bolt and the nut threads. Hot applications are usually critical. Since most of the bolts used on hot applications like turbines and casings are either stainless or precision manufactured, the replacement costs are extremely high.

The galling also occurs not just between the threads of the bolt and the nut, but also between the face of the nut and the face of the flange in which the fastener is introduced, since the side load changes a perpendicular position of the nut to be turned. This in turn increases the turning friction of the nut and makes the bolt load generated by the torque unpredictable which can result in leaks or joint failures.

Some of the tools provided with reaction members are disclosed, for example, in U.S. Pat. Nos. 3,361,218, 4,549,438, 4,538,484, 4,607,546, 4,619,160, 4,671,142, 4,706,526, 4,928,558, 5,027,932, 5,016,5, 5,142,951, 5,152,200, 5,301,574, 5,791,619, 6,260,443, and 6,715,381.

SUMMARY OF THE INVENTION

Accordingly, it is an object of the present invention to provide a fluid-operated torque wrench for and method of tightening and loosening fasteners, which are further improvements of the existing wrenches for and methods of tightening or loosening fasteners.

In keeping with these objects and with others which will become apparent hereinafter, one feature of the present invention resides, briefly stated, in a fluid-operated torque wrench for tightening or loosening a fastener, comprising a housing having two housing portions including a cylinder portion and a driving portion; cylinder-piston means arranged in said cylinder portion and movable along a first axis, a ratchet mechanism arranged in said driving portion and connected to said cylinder-piston means to be driven by the later, said ratchet mechanism having a ratchet turnable about a second axis which is perpendicular to said first axis; at least three connecting means including first and second connecting means receiving a given turning force acting in one direction during operation of the wrench, and a third connecting means receiving a given turning force in another opposite direction during operation of the wrench and being equal to said given turning force acting in said one direction, so that one of said turning forces turns a fastener to be tightened or loosened while another of said turning forces is transferred to a stationary object.

Another feature of the present invention resides, briefly stated, in a method of tightening or loosening a fastener, comprising the steps of providing a housing having two housing portions including a cylinder portion and a driving portion; arranging cylinder-piston means in said cylinder portion and moving along a first axis; arranging a ratchet mechanism in said driving portion and connecting to said cylinder-piston means to be driven by the later; providing in said ratchet mechanism a ratchet turnable about a second axis which is perpendicular to said first axis; providing at least three connecting means including first, second and third connecting means; receiving by said first and second connecting means a given turning force acting in one direction during operation of the wrench; and receiving by said third connecting means a given turning force in another opposite direction during operation of the wrench and being equal to said given turning force acting in said one direction, so that one of said turning forces turns a fastener to be tightened or loosened while another of said turning forces is transferred to a stationary object.

When the fluid operated torque wrench for tightening or loosening fasteners is designed and the method of tightening or loosening of fasteners is performed in accordance with the present invention, the wrench can be applied as any torque wrench on regular applications, which represent the majority and since it is simpler to use one reaction arm on one of the first and second connecting means.

For critical applications, it is important to apply as little side road as possible to reduce a frictional scatter, to avoid a galling of bolt thread and nut face, and to improve an overall torque accuracy. This can be achieved by using two connecting means, for two reaction members on the housing of the wrench, in particular the first and the second connecting means, including one of the first and second connecting means provided on a usual location around the cylinder portion of the housing and another of the first and second connecting means provided, for example, on the driving portion of the housing. By placing one reaction arm on each of the first and second connecting means, the reaction members can abut against two stationary objects on opposite sides of the axis of the third connecting means that connects the wrench with the fastener, such as the nut to be tightened or loosened.

When the axis of the third connecting means which connects the tool with the nut is located in a center, one abutment area for one reaction arm is located at the left side of the center and another abutment area for another reaction arm is located at the right side of the center, and the reaction arm that abuts to the right of the center pushes its abutment area backwards from the center, while the reaction arm that abuts at the left side of the center pushes its abutment area forwards from the center. Since action and reaction are equal but opposite, the connecting means for the reaction arm that abuts to the right of the center pushes the driving portion of the housing forwards from the center, while the reaction arm that abuts to the left of the center pushes the driving portion of the housing backward from the center. Since both reaction arms apply an equal force, the usual side loads apply to the driving portion of the wrench balance each other out. It is to be understood that if the wrench is used with only one reaction arm, the usual side loads will be acting.

The advantage of the inventive tool also resides in its universality. With two connecting means (first and second), users who dislike changes and constitute 95% of all users will be willing to use the inventive tool because it allows them to apply the reaction arm the way they are used to. At the same time, when this does not work for them, they will have a possibility to apply extensions, to interconnect two wrenches with one another, to eliminate the reaction arm and to reduce the usual side loads with the use of two reaction arms that balance out the side loads.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
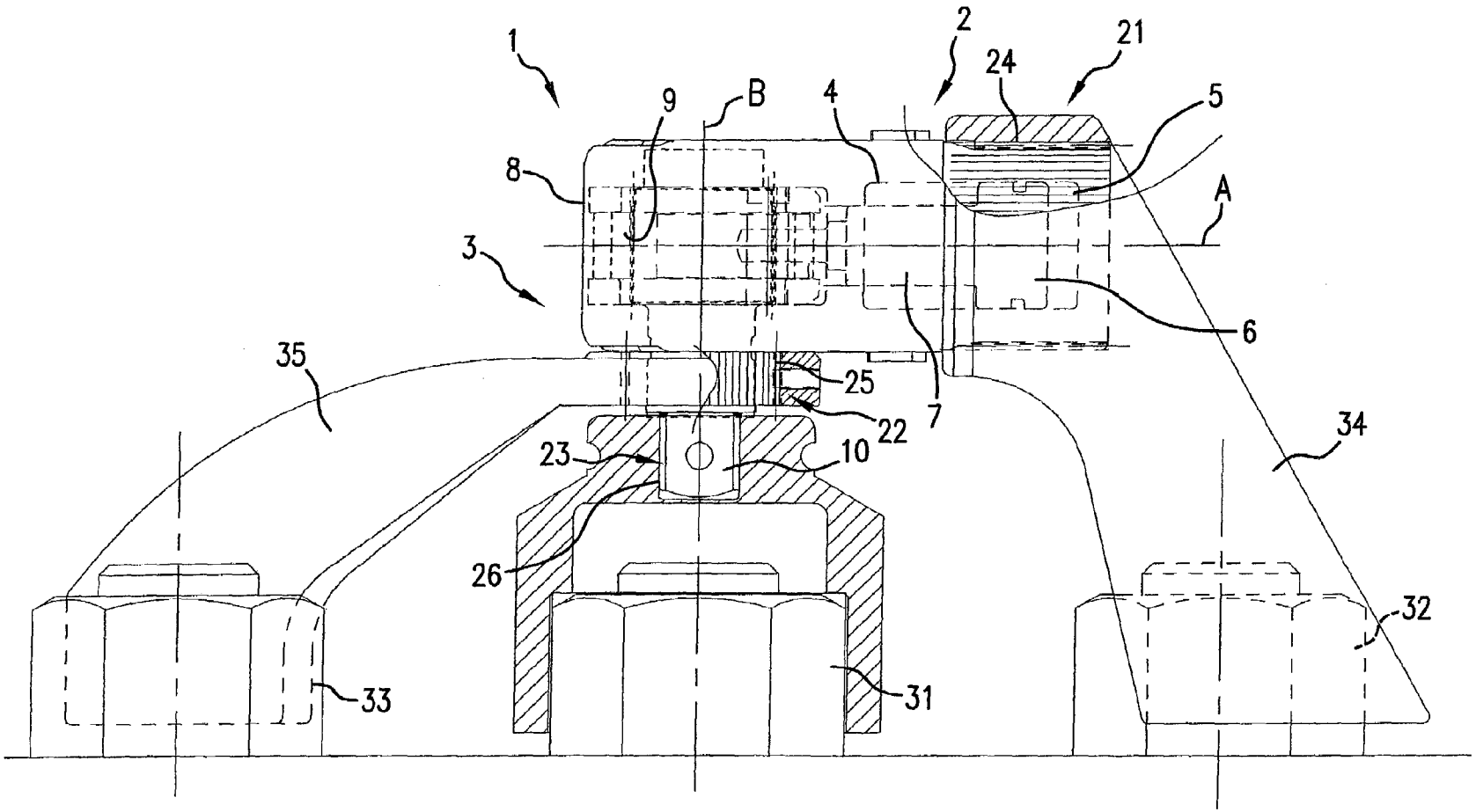
FIG. 1 is a side view of a fluid-operated torque wrench for tightening or loosening a fastener in accordance with the present invention.

A fluid-operated torque wrench in accordance with the present invention has a housing which is identified as a whole with reference numeral 1. The housing has two housing portions, including a cylinder portion 2 and a driving portion 3.

Cylinder-piston means 4 are arranged in the cylinder portion 2 and include a cylinder which is identified with reference numeral 5, a piston reciprocatingly movable in the cylinder along an axis A and identified with reference numeral 6, and a piston rod 7 connected with the piston 6. The driving portion 3 of the housing accommodates a known lever-type ratchet mechanism which is identified as a whole with reference numeral 8 and includes a ratchet 9 which is turnable in the driving portion 3 of the housing about an axis B that is perpendicular to the first axis A, as well known. The ratchet 9 is connected with a driving element 10 for joint rotation therewith.

In accordance with the present invention, the fluid-operated torque wrench is provided with at least three connecting means. The connecting means include first connecting means which are identified with reference numeral 21, second connecting means which are identified with reference numeral 22, and third connecting means which are identified with reference numeral 23.

The first connecting means are configured for example as a polygonal formation 24 which is formed, for example, on a part of the cylinder portion 2 of the housing 1 and configured, for example, as a plurality of outer splines.

The second connecting means are formed, for example, as a polygonal formation 25 formed, for example, on a projection of the driving portion 3 of the housing 1 and configured, for example, as a polygonal formation formed, for example, by a plurality of outer splines.

The third connecting means 23 includes a polygonal formation 26 provided on the driving element 11 and configured, for example, as a polygonal outer surface, such as a square outer surface.

Figure 2:
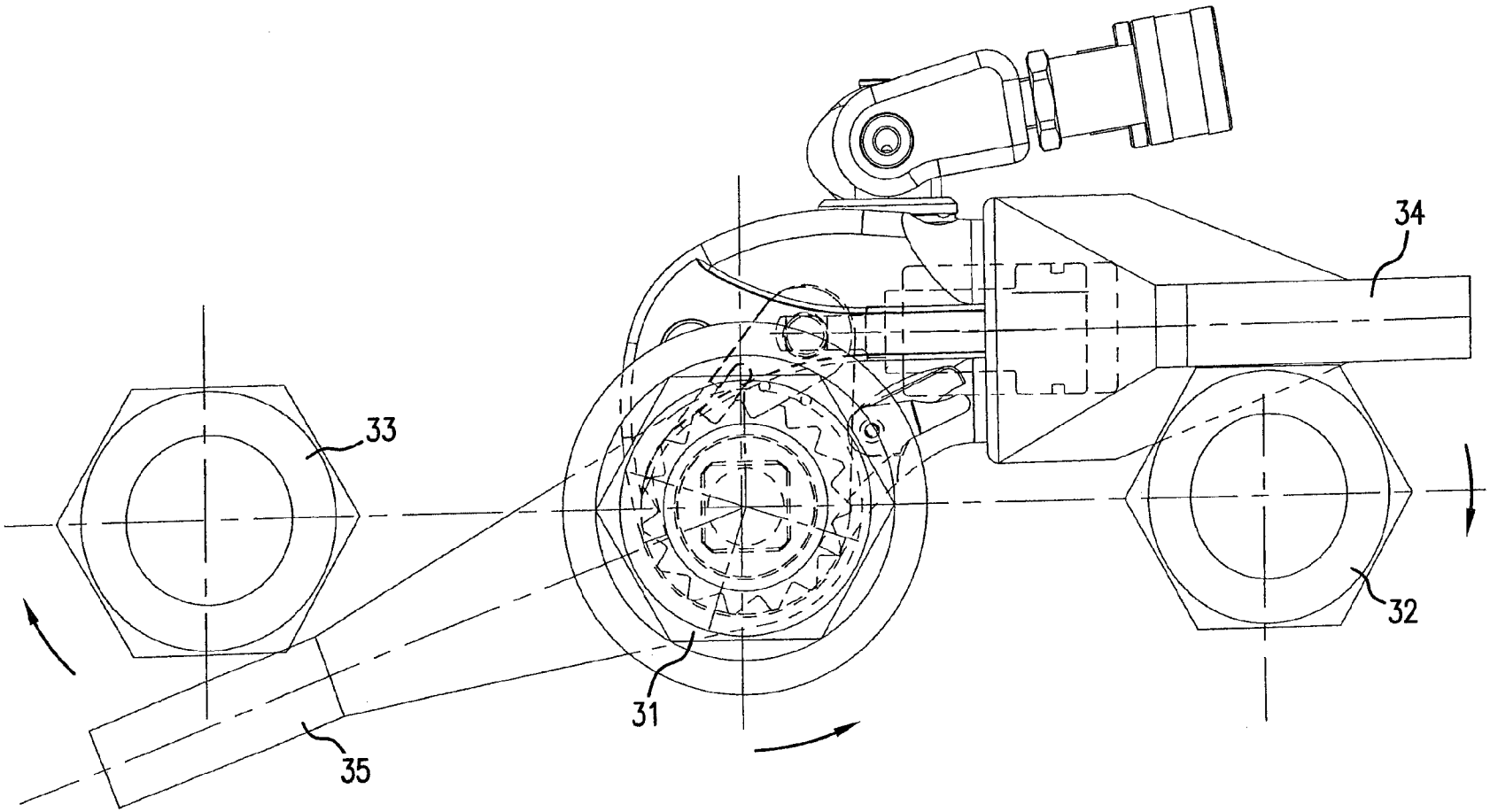
FIG. 2 is a plan view of the inventive fluid-operated torque wrench for tightening or loosening a fastener.

The first connecting means 21, the second connecting means 22, and the third connecting means 23 are configured so that during operation of the wrench the first connecting means 21 and the second connecting means 22 receive a given turning force acting in one direction, while the third connecting means 23 receive a turning force in an opposite direction as shown by arrows in FIG. 2 of the drawings.

When the ratchet 9 turns in the driving portion 3 of the housing 1 in the other direction and drives the driving element 10 to tighten or loosen a nut 31, the first connecting means 21 transfers a given turning force to a stationary object which is, for example, a neighboring nut 32 and the second connecting means 23 transfers a given turning force to another stationary object which is, for example, a neighboring nut 33 in the one direction which is opposite to the other direction.

In another mode of operation the first connecting means 21 and the second connecting means 22 can receive a given turning force in one direction to turn the fasteners, such as the nuts 32 and 33, while the ratchet 9 of the lever-type ratchet mechanism in the driving portion 3 of the housing 1 applies another turning force which is equal to the above mentioned given turning force acting in one direction, to the stationary object which in this case is the nut 31, in another direction which is opposite to the one direction.

It can be seen that the given turning force of the first connecting means 21 and the second connecting means 22 acting in one direction can be transferred by one of the first connecting means 21 and the second connecting means 22 to the stationary object 32 or 33, or the given turning force of the first connecting means 21 and the second connecting means 22 acting in one direction can be transferred by said first connecting means 21 and the second connecting means 22 for turning a fastener, in particular the nut 32 and 33.

The first connecting means 21 and the second connecting means 22 can be both used for transferring the given turning force by the first connecting means 21 and the second connecting means 22 to the stationary objects represented by the nuts 32 and 33 or for turning the nut 32 and 33. At the same time it is possible to use only one of the first and second connecting means 21 and 22 for transferring the given turning force to one of the stationary objects represented by one of the nuts 32 or 33 or to turn one of the nuts 32 or 33, depending on applications of the fluid-operated torque wrench.

In accordance with the present invention, while the first connecting means 21 is arranged on the usual location around the cylinder portion of the housing 1, the second connecting means 22 is arranged around the drive or the driving element on the driving portion 3 of the housing 1. By connecting reaction arms 34 and 35 to the first connecting means 21 and the second connecting means 32 and placing the reaction arms 34 and 35 against two stationary objects 32 and 33 on opposite sides of the axis of the connecting means 23 to the nut 31 to be tightened or loosened, the nut 31 to be tightened or loosened is located in the center, one abutment area for the reaction arm 35 is arranged at the left side of the center and the other reaction arm 34 is arranged at the right side of the center, so that the reaction arm 34 that abuts at the right of the center pushes its abutment area backwards from the center, while the reaction arm 35 that abuts at the left side of the center pushes its abutment area forwards from the center.

Since action and reaction are equal but opposite, the connecting means 21 for the reaction arm 34 that abuts at the right of the center pushes the driving portion of the housing forwards from the center, while the reaction arm 35 that abuts at the left of the center pushes the driving portion backwards. Since both apply an equal force, the usual side loads applied to the driving portion of the wrench balance each other out when both reaction arms 34 and 35 are used. Of course, the wrench can be used with only one of the reaction arms 34 or 35, as explained above.

It will be understood that each of the elements described above, or two or more together, may also find a useful application in other types of constructions differing from the type described above.

While the invention has been illustrated and described as embodied in a fluid-operated torque wrench for and a method for tightening and loosening fasteners, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A fluid-operated torque wrench for tightening or loosening a fastener, comprising a housing having two housing portions including a cylinder portion and a driving portion; cylinder-piston means arranged in said cylinder portion and movable along a first axis; a ratchet mechanism arranged in said driving portion and connected to said cylinder-piston means to be driven by the later, said ratchet mechanism having a ratchet turnable about a second axis which is perpendicular to said first axis; at least three connecting means including a first connecting means for receiving a given turning force acting in one direction during operation of the wrench; a second connecting means receiving said given turning force acting in said one direction during operation of the wrench, and a third connecting means receiving a given turning force acting around said first axis in another opposite direction during operation of the wrench and being equal to said given turning force acting in said one direction so that one of said turning forces turns a fastener to be tightened or loosened while another of said turning forces is transferred to a stationary object; at least three force-transmitting elements including a first force-transmitting element attached to said first connecting means for abutting against a first stationary object, a second force-transmitting element attached to said second connecting means for abutting against a second stationary object, and a third force-transmitting element attached to said third connecting means for turning a fastener, said third force-transmitting element being coaxial with said second axis while said first and second force-transmitting elements are located at opposite sides from said third force-transmitting element as considered in a circumferential direction and at opposite sides of said second axis, said first, second and third connecting means being separate from each other, and said first and second force-transmitting elements being configured as separate force-transmitting elements which are directly attachable separately, individually and independently from said third force-transmitting element and from each other to said first and second connecting means correspondingly without connecting said first and second force-transmitting elements to said third force-transmitting element and to each other, to abut separately, individually and independently against the first and second neighboring objects, wherein one of said first and second connecting means is provided on said cylinder portion of said housing while the other of said first and second connecting means is provided on said driving portion of said housing, and said third connecting means is provided on a driving element which is driven by said ratchet mechanism and extends from said driving portion of said housing.

2. A fluid-operated torque wrench for tightening or loosening a fastener, comprising a housing having two housing portions including a cylinder portion and a driving portion; cylinder-piston means arranged in said cylinder portion and movable along a first axis; a ratchet mechanism arranged in said driving portion and connected to said cylinder-piston means to be driven by the later, said ratchet mechanism having a ratchet turnable about a second axis which is perpendicular to said first axis; at least three connecting means including a first connecting means for receiving a given turning force acting in one direction during operation of the wrench; a second connecting means receiving said given turning force acting in said one direction during operation of the wrench, and a third connecting means receiving a given turning force acting around said first axis in another opposite direction during operation of the wrench and being equal to said given turning force acting in said one direction so that one of said turning forces turns a fastener to be tightened or loosened while another of said turning forces is transferred to a stationary object; at least three force-transmitting elements including a first force-transmitting element attached to said first connecting means for abutting against a first stationary object, a second force-transmitting element attached to said second connecting means for abutting against a second stationary object, and a third force-transmitting element attached to said third connecting means for turning a fastener, said third force-transmitting element being coaxial with said second axis while said first and second force-transmitting elements are located at opposite sides from said third force-transmitting element as considered in a circumferential direction and at opposite sides of said second axis, said first, second and third connecting means being separate from each other, and said first and second force-transmitting elements being configured as separate force-transmitting elements which are directly attachable separately, individually and independently from said third force-transmitting element and from each other to said first and second connecting means correspondingly without connecting said first and second force-transmitting elements to said third force-transmitting element and to each other, to abut separately, individually and independently against the first and second neighboring objects, wherein said first and second connecting means are provided directly on said housing, so that said first and second force-transmitting elements are connected with said housing directly through said first and second connecting means.

3. A fluid-operated torque wrench as defined in claim 2, wherein said connecting means are configured so that said ratchet turns in said driving portion to tighten or loosen a nut in the other direction which is opposite to said one direction in which first and second connecting means transfer a given turning force to the stationary object.

4. A method of tightening or loosening a fastener, comprising the steps of providing a housing having two housing portions including a cylinder portion and a driving portion; moving cylinder-piston means in said cylinder portion along a first axis; connecting a ratchet mechanism arranged in said driving portion to said cylinder-piston means to be driven by the later; turning a ratchet of the ratchet mechanism about a second axis which is perpendicular to said first axis; providing at least three connecting means including a first connecting means for receiving a given turning force acting in one direction during operation of the wrench; a second connecting means for receiving said given turning force acting in said one direction during operation of the wrench, and a third connecting means for receiving a given turning force acting around said first axis in another opposite direction during operation of the wrench and being equal to said given turning force acting in said one direction so that one of said turning forces turns a fastener to be tightened or loosened while another of said turning forces is transferred to a stationary object; providing at least three force-transmitting elements including a first force-transmitting element attached to said first connecting means for abutting against a first stationary object, a second force-transmitting element attached to said second connecting means for abutting against a second stationary object, and a third force-transmitting element attached to said third connecting means for turning a fastener, arranging said third force-transmitting element coaxial with said second axis while arranging said first and second force-transmitting elements at opposite sides from said third force-transmitting element as considered in a circumferential direction and at opposite sides of said second axis; forming said first, second and third connecting means being separate from each other; and configuring said first and second force-transmitting elements as separate force-transmitting elements which are directly attachable separately, individually and independently from said third force-transmitting element and from each other to said first and second connecting means correspondingly to abut separately, individually and independently against the first and second neighboring objects without connecting the first and second force-transmitting elements with one another and with said third force-transmitting element, further comprising providing one of said first and second connecting means on said cylinder portion of said housing while providing the other of said first and second connecting means on said driving portion of said housing, and providing said third connecting means on a driving element which is driven by said ratchet mechanism and extends from said driving portion of said housing.

5. A method of tightening or loosening a fastener, comprising the steps of providing a housing having two housing portions including a cylinder portion and a driving portion; moving cylinder-piston means in said cylinder portion along a first axis; connecting a ratchet mechanism arranged in said driving portion to said cylinder-piston means to be driven by the later; turning a ratchet of the ratchet mechanism about a second axis which is perpendicular to said first axis; providing at least three connecting means including a first connecting means for receiving a given turning force acting in one direction during operation of the wrench; a second connecting means for receiving said given turning force acting in said one direction during operation of the wrench, and a third connecting means for receiving a given turning force acting around said first axis in another opposite direction during operation of the wrench and being equal to said given turning force acting in said one direction so that one of said turning forces turns a fastener to be tightened or loosened while another of said turning forces is transferred to a stationary object; providing at least three force-transmitting elements including a first force-transmitting element attached to said first connecting means for abutting against a first stationary object, a second force-transmitting element attached to said second connecting means for abutting against a second stationary object, and a third force-transmitting element attached to said third connecting means for turning a fastener, arranging said third force-transmitting element coaxial with said second axis while arranging said first and second force-transmitting elements at opposite sides from said third force-transmitting element as considered in a circumferential direction and at opposite sides of said second axis; forming said first, second and third connecting means being separate from each other; and configuring said first and second force-transmitting elements as separate force-transmitting elements which are directly attachable separately, individually and independently from said third force-transmitting element and from each other to said first and second connecting means correspondingly to abut separately, individually and independently against the first and second neighboring objects without connecting the first and second force-transmitting elements with one another and with said third force-transmitting element, further comprising providing said first and second connecting means directly on said housing, and connecting said first and second force-transmitting elements with said housing directly through said first and second connecting means.

6. A method as defined in claim 5, further comprising configuring said connecting means so that said ratchet turns in said driving portion to tighten or loosen a nut in the other direction which is opposite to said one direction in which first and second connecting means transfer a given turning force to the stationary object.

* * * * *